US008511852B1

(12) United States Patent
Vann et al.

(10) Patent No.: US 8,511,852 B1
(45) Date of Patent: Aug. 20, 2013

(54) SYSTEMS, METHODS, AND DEVICES FOR PROVIDING BRACKET-BASED LED LIGHTING SOLUTIONS FOR LIGHT FIXTURES

(75) Inventors: Steen Vann, Morrow, GA (US); Evans Edward Thompson, III, Fairburn, GA (US); Megan Christen, Golden, CO (US); Jerold Alan Tickner, Newnan, GA (US); Christopher Lee Bohler, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 221 days.

(21) Appl. No.: 12/973,441

(22) Filed: Dec. 20, 2010

Related U.S. Application Data

(60) Provisional application No. 61/288,073, filed on Dec. 18, 2009.

(51) Int. Cl.
*F21V 9/16* (2006.01)
*G09F 13/04* (2006.01)

(52) U.S. Cl.
USPC ..... 362/235; 362/249.02; 362/97.1; 257/88

(58) Field of Classification Search
CPC ..... H01L 33/488; F21K 9/30; H05K 3/341
USPC ..... 362/101, 154, 800; 219/433
See application file for complete search history.

(56) References Cited

U.S. PATENT DOCUMENTS

| | | | | |
|---|---|---|---|---|
| 2004/0070333 | A1 * | 4/2004 | Lin et al. | 313/500 |
| 2009/0103295 | A1 * | 4/2009 | Wang | 362/234 |
| 2010/0110683 | A1 * | 5/2010 | Fang et al. | 362/249.02 |

* cited by examiner

*Primary Examiner* — Tracie Y Green
(74) *Attorney, Agent, or Firm* — King & Spalding LLP

(57) ABSTRACT

Systems, methods, and devices of the invention are directed to a light fixture that includes a housing with a bottom wall, a front wall, a back wall, two side walls, and an aperture, a reflector connected to the housing, and one or more bracket-based LED light sources segments connected to at least one of the front wall, the back wall, or the two side walls of the housing. In some embodiments of the invention, the housing is a wall mount housing. In some embodiments of the invention the bracket-based LED light source includes a bracket shaped to position the LED light source to emit a particular optical distribution from the aperture of the housing, and/or the bracket is shaped to thermally disburse heat radiating from the LED light source. In other embodiments of the invention, a portion of a bracket of at least one bracket-based LED light source is flexible.

20 Claims, 15 Drawing Sheets

SYSTEMS, METHODS, AND DEVICES FOR PROVIDING BRACKET-BASED LED LIGHTING SOLUTIONS FOR LIGHT FIXTURES

RELATED PATENT APPLICATION

This patent application claims priority under 35 U.S.C. § 119 to U.S. Provisional Patent Application No. 61/288,073, titled "Systems, Methods, and Devices for Providing Bracket-Based LED Lighting Solutions for Light Fixtures" and filed Dec. 18, 2009, the complete disclosure of which is hereby fully incorporated herein by reference.

TECHNICAL FIELD

Embodiments of the invention relate generally to lighting fixtures, and more particularly to systems, methods, and devices for providing bracket-based light emitting diode (LED) lighting solutions for light fixtures.

BACKGROUND

For traditional light source design, the light source position within the fixture housing has been either fixed and the design of the distribution of the light has been "adjusted" via the reflector and the configuration or use of the window/optics or the window of the housing, or the source would be positioned in relation to the optic being used. Recently, light fixtures have incorporated LEDs for general lighting applications. The use of LEDs as light sources in fixtures present unique challenges and opportunities in configuring light sources in new and existing fixture housings, such as thermal management concerns, smaller light source footprint, undesirable point source aesthetics, etc. What is needed is an incorporation of LED light sources into fixtures that addresses one or more of these challenges and opportunities.

SUMMARY

According to an embodiment of the invention, there is disclosed a light fixture that includes a housing with a bottom wall, a front wall, a back wall, and at least two side walls, where the housing forms an aperture. The light fixture further includes a reflector connected to the housing, and two or more bracket-based light emitting diode (LED) light sources segments connected to at least one of the front wall, the back wall, or the side walls of the housing.

In accordance with one aspect of the invention, the housing may be a wall mount housing. In example embodiments of the invention, the light fixture may be for general light purposes, for instance an area light for indoor use, outdoor use, or both. According to another aspect of the invention, the bracket-based LED light source includes a bracket that is shaped to position the LED light source to emit a particular optical distribution from the aperture of the housing. In accordance with yet another aspect of the invention, the bracket-based LED light source includes a bracket that is shaped to thermally disburse heat radiating from the LED light source. According to another aspect of the invention a portion of at least one of the bracket-based LED light sources is flexible.

In accordance with another embodiment of the invention, there is disclosed a light fixture that includes a housing with a bottom wall, a front wall, a back wall, and at least two side walls, where the housing forms an aperture. The light fixture further includes one or more heat sink brackets mounted to one of the front wall, the back wall, or the side walls of the housing. The heat sink bracket includes a lower portion that contains at least one aperture for mounting the heat sink bracket to the housing. The heat sink bracket further includes a middle portion and an upper portion. The light fixture also includes at least one LED mounted to the upper portion of the heat sink bracket.

According to one aspect of the invention, the middle portion of the heat sink bracket includes at least one routing aperture for threading wiring providing power to the at least one LED. In accordance with another aspect of the invention, the upper portion of the heat sink bracket includes at least one lead aperture for threading at least one wire lead providing power to the at least one LED. According to yet another aspect of the invention, the lead aperture(s) is larger in size than the routing aperture(s). In accordance with another aspect of the invention, the light fixture further includes a wire way gasket. According to yet another aspect of the invention, the light fixture further includes an outlet box gasket.

In accordance with another aspect of the invention, the middle portion and upper portion are integral to each other and separated by a bend in the heat sink bracket. According to yet another aspect of the invention, the upper portion may be bendable in relation to the middle portion. In accordance with another aspect of the invention, the heat sink bracket is mounted to at least two of the front wall, the back wall, or the at least two side walls of the housing. According to yet another aspect of the invention, the lower portion is in sufficient contact with the housing to thermally route heat generated by the at least one LED to the housing. In accordance with another aspect of the invention, the lower portion is in sufficient contact with a plate within the housing to thermally route heat generated by the at least one LED to the plate.

According to yet another embodiment of the invention, there is disclosed a light fixture that includes a housing with a bottom wall, a front wall, a back wall, and at least two side walls, where the housing forms an aperture. The light fixture further includes at least one heat sink bracket located within the housing. The heat sink bracket includes: a lower portion containing at least one mounting aperture for mounting the at least one heat sink bracket. The heat sink bracket further includes a middle portion and an upper portion, where the upper portion and/or middle portion includes at least one routing aperture for threading at least one wire. Moreover, the middle portion and upper portion are integral to each other and separated by a bend in the heat sink bracket. The fixture also includes at least one LED mounted to the upper portion of the heat sink bracket.

BRIEF DESCRIPTION OF THE FIGURES

Reference will now be made to the accompanying drawings, which are not necessarily drawn to scale, and wherein.

DETAILED DESCRIPTION OF EXEMPLARY EMBODIMENTS

Figure 1:
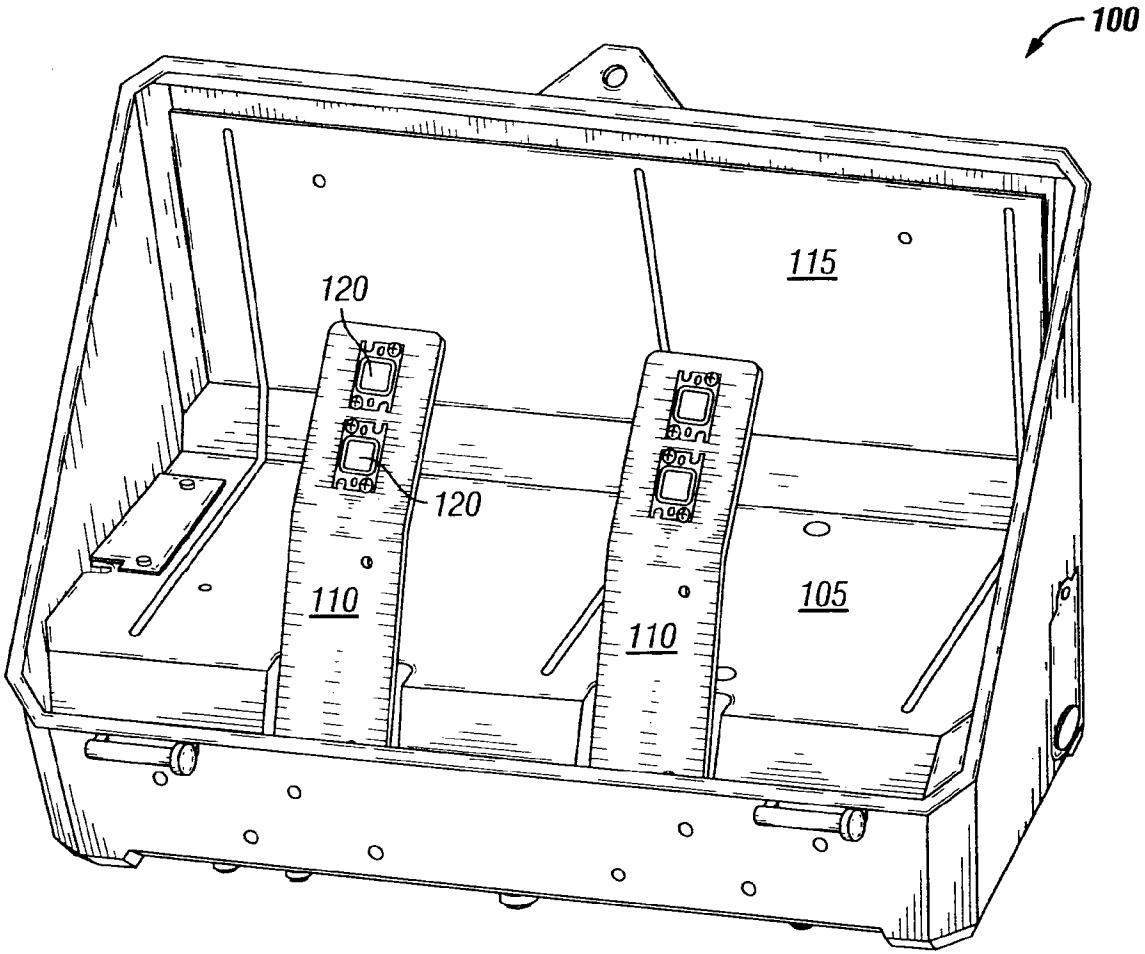
FIG. 1 illustrates a light fixture using multiple bracket-based LED light sources in accordance with a first embodiment of the invention.

Embodiments of the invention are directed to the use of bracket-based LED sources in various locations within a lighting fixture where the location of the LED light sources provides some affect to the light distribution of the fixture. For instance, in some embodiments of the invention, the bracket-based LED light source may be connected to the front wall of the internal housing of the fixture, the bottom of the internal housing of the fixture, and/or a side wall of the fixture housing. In another embodiment of the invention, the bracket (s) containing the LED light source may be geometrically shaped and/or configured to address a performance characteristic of the LED light source or the fixture itself (e.g., handling thermal management of the LED light engine, altering the position of the LED light source in the housing to meet desired optical distribution requirements, efficiencies, etc.). In yet another embodiment of the invention, the bracket-based LED sources may be adjustable (e.g., the angle of the bracket face may be adjustable, etc.) to achieve a desired light distribution from the fixture. Such adjustability may be utilized in the construction of the light fixture and/or allow for adjustments out in the field.

The systems and methods described herein may provide several advantages including locating the bracket-based LED light sources in the fixture housing to produce a particular, desired optical distribution. For instance, multiple locations of the LED light sources can increase side-to-side distribution resulting in wider spacing between installed light fixtures. The systems, methods, and apparatuses described herein may also include multiple bracket-based LED light sources as a way to separate the light sources and/or better disburse the heat from the light sources. The brackets may also be inexpensive thermal conductors, and the bracket geometric configurations may also be used to decrease the distance to the heat sink of the housing.

Embodiments of the invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 and 4, 6 and 9, and 12 illustrate three example embodiments incorporating bracket-based LED sources in a light fixture. In certain embodiments of the invention, the position of the LEDs may depend on the desired optical distribution from the fixture. In some embodiments of the invention, the desired optical distribution may be a balance of forward light throw from the fixture and lateral light throw from the fixture as well as decreasing the amount of light displayed directly below the fixture. This results in a uniformity performance at fixture spacings equal to traditional light sources such as High Intensity Discharge (HID) sources. In addition to the different locations of the bracket-based LED light sources shown in the referenced figures, different reflector materials or reflector shaping may provide different light distributions from the fixture. Example reflectors incorporated in various embodiments of the invention are shown in FIGS. 2C, 3B, 7B, 8B, and 14.

FIGS. 2A-B, 3A-3B, 7A-7B, 8A-8B, 13, and 14 illustrate example layouts of the various components of the housings and how configurations are modified based on the placement of the bracket-based LED light sources. In at least some of the embodiments of the invention there was consideration in the placement of the heat sinks in the fixture layout by having the heat sinks out of the way of the wiring access hole so as to avoid interference with the wiring procedure during installation.

FIGS. 5A-5B, 10A-10B, 11A-11B, 15A-15B, and 16A-16B show various configurations of the bracket-based LED light source. As shown in the figures, the brackets may be constructed in various geometric shapes to locate the LED light engines in a particular location/configuration in the housing to achieve a desired performance associated with the light fixture (e.g., handle thermal management of the LED light engine, alter the position of the LED light source in the housing to meet desired optical distribution requirements, efficiencies, etc.). In some embodiments of the invention, the brackets of the bracket-based LED light source may be constructed such that the portion of the bracket where the LED light engine is attached to the bracket may be movable or otherwise flexible to allow for factory or even field adjustment to achieve different light distributions from the fixture.

Although not shown in the figures, the fixture may include a window. In some embodiments, the window may be comprised of borosilicate glass to make the system appear more "HID-like" (in such embodiments, the bracket-based LED light sources may be brought closer together to make a more consistent appearance across the face of the glass increasing the "HID-like" performance. In other embodiments, the window may be clear glass or Solite® glass (which smoothes out the light distribution).

FIG. 1 illustrates a light fixture 100 using multiple bracket-based LED light sources in accordance with a first embodiment of the invention. As shown in the example embodiment of FIG. 1, a light fixture housing 105 contains a reflector 115 and heat sink brackets 110 with LED light sources (or LED light engine, discrete LEDs or LED dies) 120 mounted to the heat sink brackets 110. In one exemplary embodiment, the LED light engine is an LED chip on board that includes one or multiple LED light sources, one or more discrete LEDs, or one or more LED dies disposed on, coupled to, or removably coupled to each bracket 110. While the exemplary embodiment shows two LED chips/engines 120 on each bracket 110, the number of chips/engines (hereinafter referred to simply as LED light sources) 120 on each bracket can be one or any number more than one. The heat sink brackets 110 are configured at an angle to allow for the LED light sources 120 to emit light out of the fixture housing 115 while providing thermal management for the operation of the LEDs. The heat sink brackets 110 may be mounted directly to one of the side walls of the housing, the bottom of the housing, a plate within the housing, other additional heat sink element within the housing, or a combination thereof.

Figure 2A:
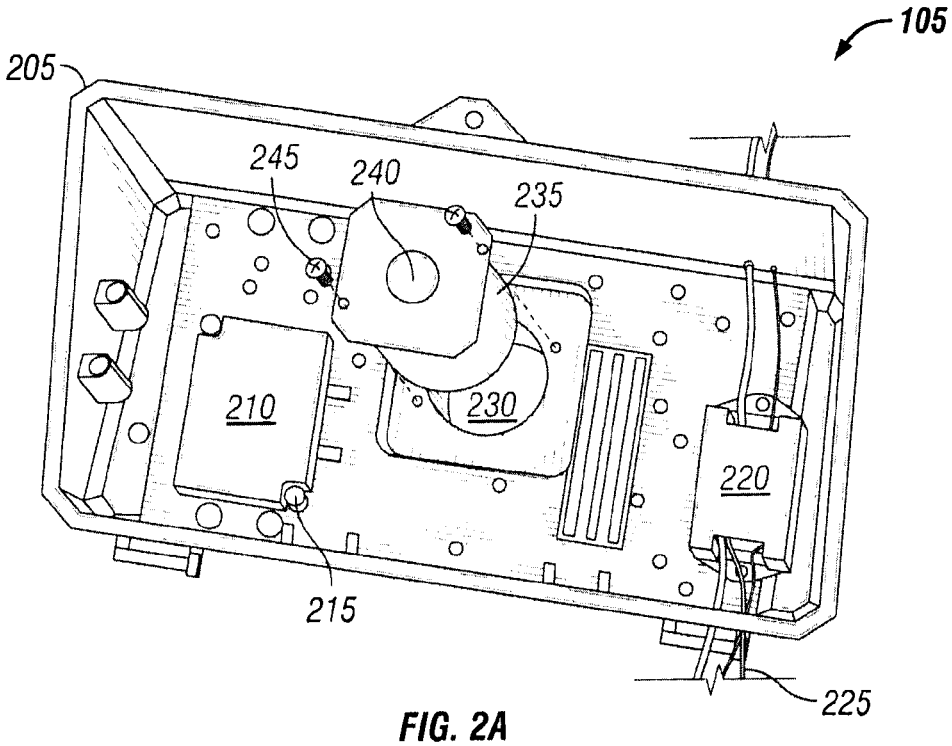
FIG. 2A illustrates a layout for the fixture without a battery backup in accordance with the embodiment of the invention shown in FIG. 1.
Figure 2B:
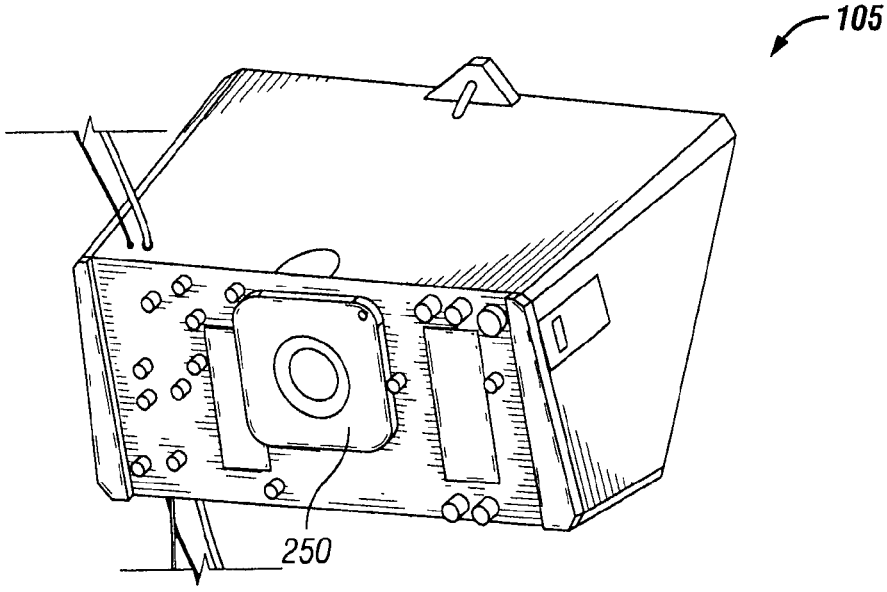
FIG. 2B illustrates a gasket incorporated into the fixture without a battery backup in accordance with the embodiment of the invention shown in FIG. 1.

FIG. 2A illustrates a layout for the fixture housing 105 without a battery backup in accordance with the embodiment of the invention shown in FIG. 1. As shown in the example embodiment of FIG. 2A, the fixture housing interior 205 contains a variety of components including an LED driver 210 mounted to the housing by an attachment means, such as a screw 215 (or a rivet, nut and bolt, etc.). Another component contained in the housing in the example embodiment is a surge module 220 shown electrically coupled with power wires 225 to the module. The bottom of the example housing 105 has an aperture 230 allowing for wires to be routed through a wire way gasket 235 and outlet box cover 240 that is mounted by cover screws 245 or known mounting or attachment means. FIG. 2B illustrates an outlet box gasket 250 incorporated into the fixture housing 105 without a battery backup in accordance with the embodiment of the invention shown in FIG. 1 to provide a wire way access to the internal components of the fixture 100.

Figure 2C:
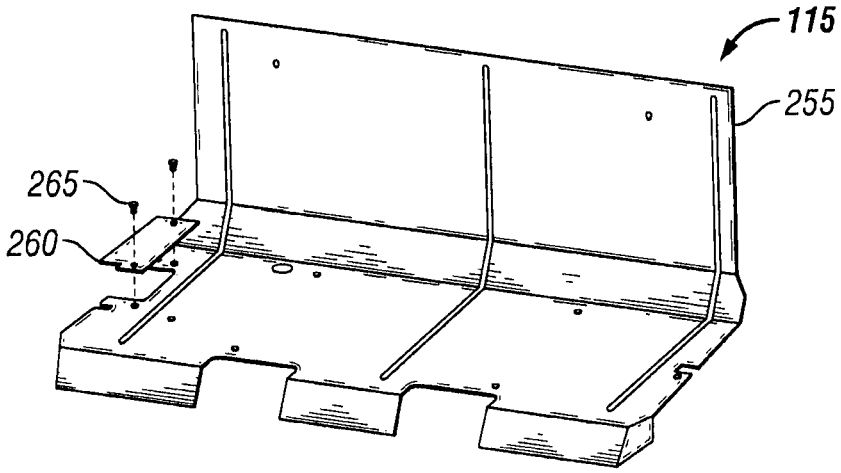
FIG. 2C illustrates a layout for the reflector incorporated into the fixture housing without a battery backup in accordance with the embodiment of the invention shown in FIG. 1.

FIG. 2C illustrates a layout for the reflector 115 incorporated into the fixture housing without a battery backup in accordance with the embodiment of the invention shown in FIG. 1. As shown in the example embodiment of FIG. 2C, the reflector 115 has a reflective surface 255 as well as a cover plate 260 for attaching the reflector to the fixture housing using, for example, a screw 265 or other attachment means (such as a rivet, nut and bolt, etc.). In one exemplary embodiment, the reflective surface 255 can include a shine metallic surface, a highly reflective paint, such as highly reflective white paint, or other known reflective surfaces.

Figure 3A:
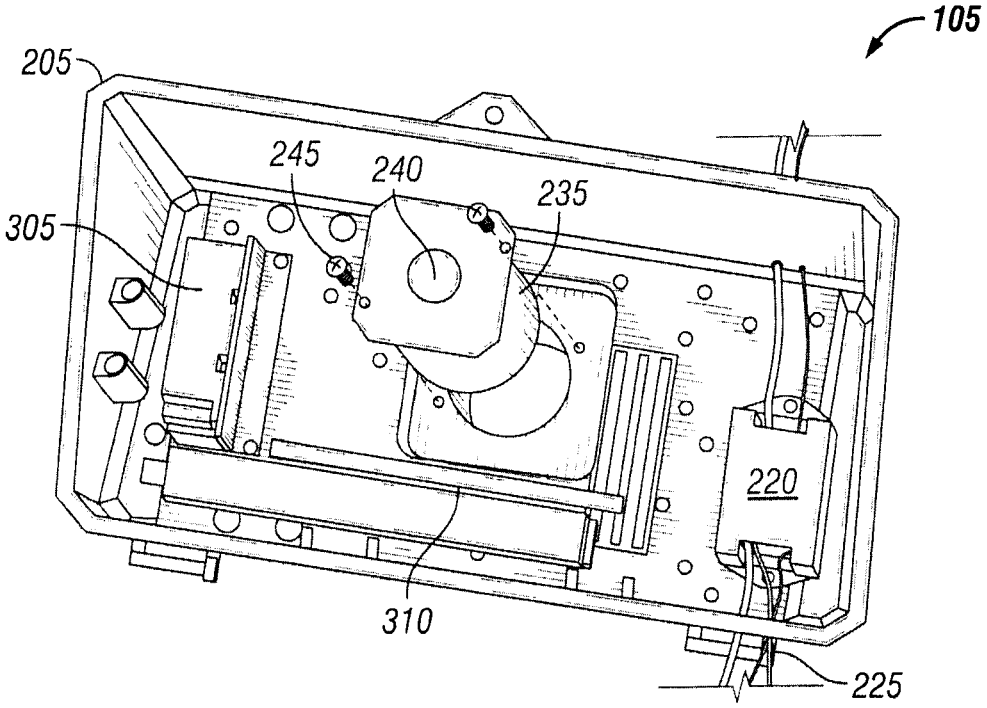
FIG. 3A illustrates a layout for the fixture with a battery backup in accordance with the embodiment of the invention shown in FIG. 1.

FIG. 3A illustrates a layout for the fixture housing 105 with a battery backup attached to a battery backup bracket 310 as well as an alternative configuration for locating the driver 305 in the fixture housing in accordance with the embodiment of the invention shown in FIG. 1.

Figure 3B:
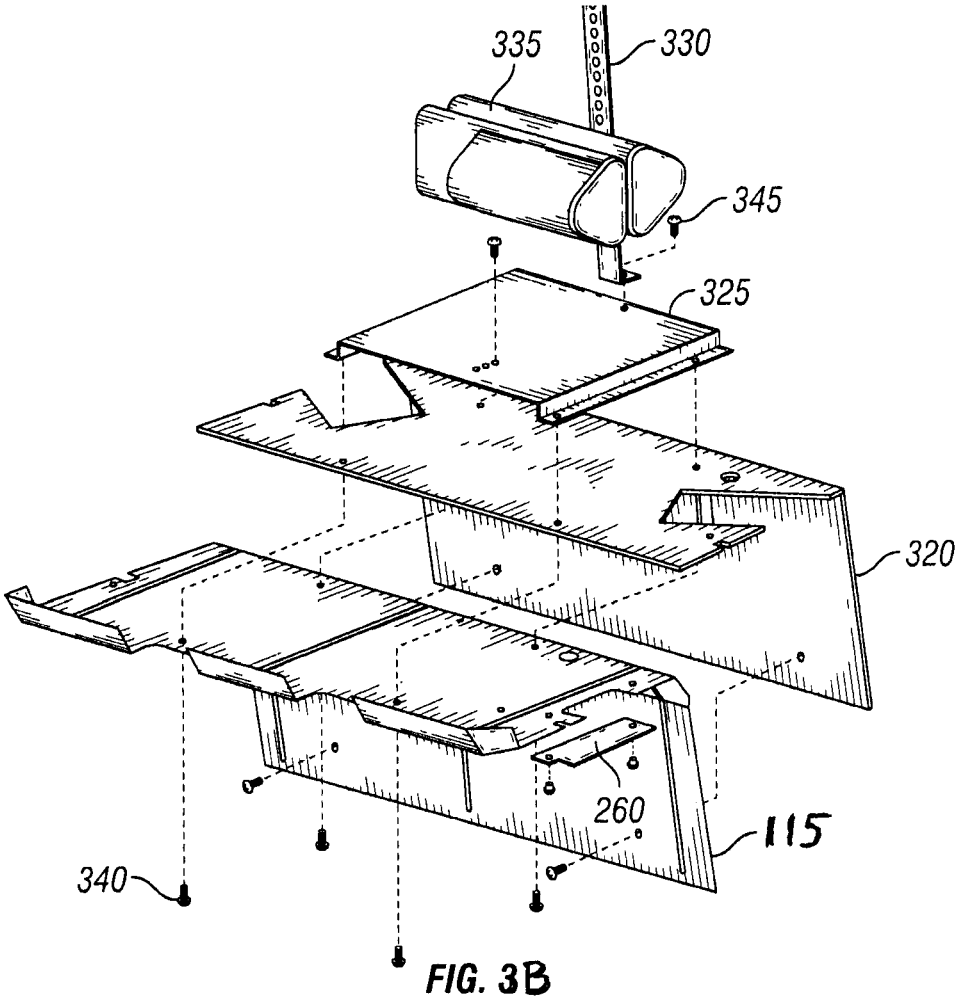
FIG. 3B illustrates a layout for the reflector incorporated into the fixture housing with a battery backup in accordance with the embodiment of the invention shown in FIG. 1.

FIG. 3B illustrates a layout for the reflector 115 incorporated into the fixture housing with a battery backup 335 in accordance with the embodiment of the invention shown in FIG. 1. As shown in FIG. 3B, a backup battery 335 may be incorporated into the fixture by being mounted to a battery mounting plate 325. In the embodiment shown in FIG. 3B the battery 335 is mounted to the batter mounting plate 325 through the use of a mounting strap 330 and screws 345. Other mounting or attachment means may be used in alternative embodiments. FIG. 3B, further shows the battery mounting plate 325 removably coupled to the support plate 320 and the reflector 115 through the use of screws 340 or alternative mounting or attachment means. In other embodiments of the invention, one or more of the battery mounting plates 325 or the support plates 320 may be omitted or made integral to each other rather than connected as separate pieces.

Figure 4:
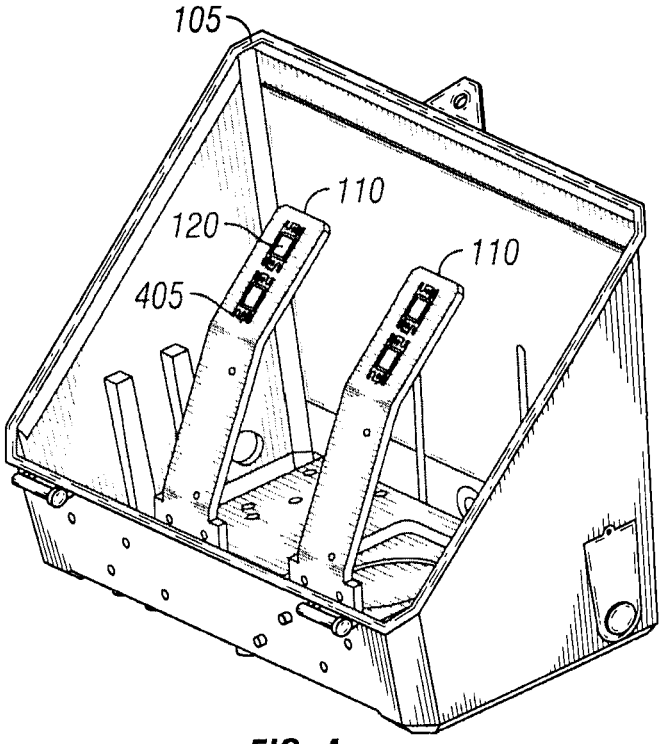
FIG. 4 illustrates a perspective view of the light fixture using multiple bracket-based LED light sources in accordance with the embodiment of the invention shown in FIG. 1.
Figure 5A:
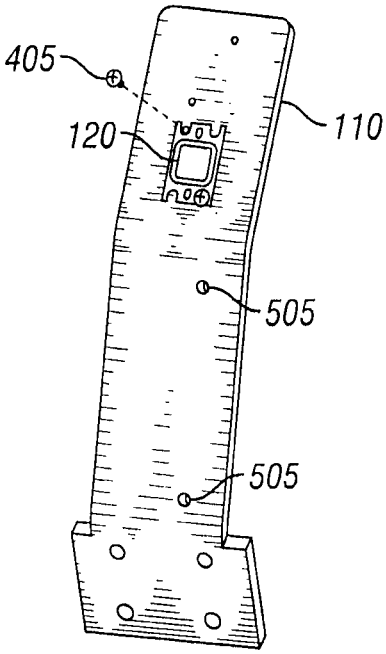
FIG. 5A illustrates a bracket-based LED light source with one LED light source in accordance with one embodiment of the invention.
Figure 5B:
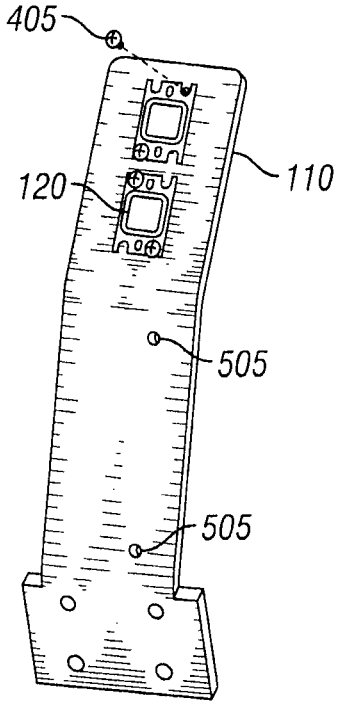
FIG. 5B illustrates a bracket-based LED light source with multiple LED light sources in accordance with one embodiment of the invention.

FIG. 4 illustrates a perspective view of the light fixture using multiple bracket-based LED light sources in accordance with the embodiment of the invention shown in FIG. 1. Further, FIGS. 5A and 5B illustrate a bracket-based LED light source with one or more LED light sources in accordance with one embodiment of the invention. As shown in FIGS. 4, 5A, and 5B, the LED light source 120 can be mounted to the heat sink bracket 110 through the use of mounting screws 405. Other mounting mechanisms may be used in other embodiments of the invention including, but not limited to, thermal grease, heat tape, and liquid or semi-liquid adhesives. Also shown in FIGS. 5A and 5B are holes 505 in the heat sink brackets 110, which may be used to route and/or secure wires (or leads) for providing electrical power to the LED light source(s) 120 on the heat sink bracket(s) 110. The heat sink brackets 110 shown in FIGS. 5A and 5B are an example shape and orientation. As is shown in other figures and described below the heat sink brackets 110 can be shaped and oriented in a variety of different ways depending on the thermal management and lighting performance needs for the fixture. The heat sink brackets 110 shown in FIGS. 5A and 5B have a lower portion for mounting to the housing or to a bracket or plate located in the fixture housing, a middle portion extending up from the lower portion, and an upper portion where the LED light source(s) are mounted. As shown in FIGS. 5A and 5B, the lower portion is wider than the middle portion of the bracket. The middle portion is angled at an orthogonal or substantially orthogonal angle to the lower portion. The middle portion and upper portion are separated by a slight bend in the heat sink bracket. In some example embodiments of the invention the bracket may be further bendable and/or flexible to vary the location of the LEDs 120 and/or the aim of the light emitted. In some embodiments of the invention the heat sink brackets 110 may be made up of separate pieces that are coupled together or a one-piece bracket shaped accordingly as shown in FIGS. 5A and 5B.

Figure 6:
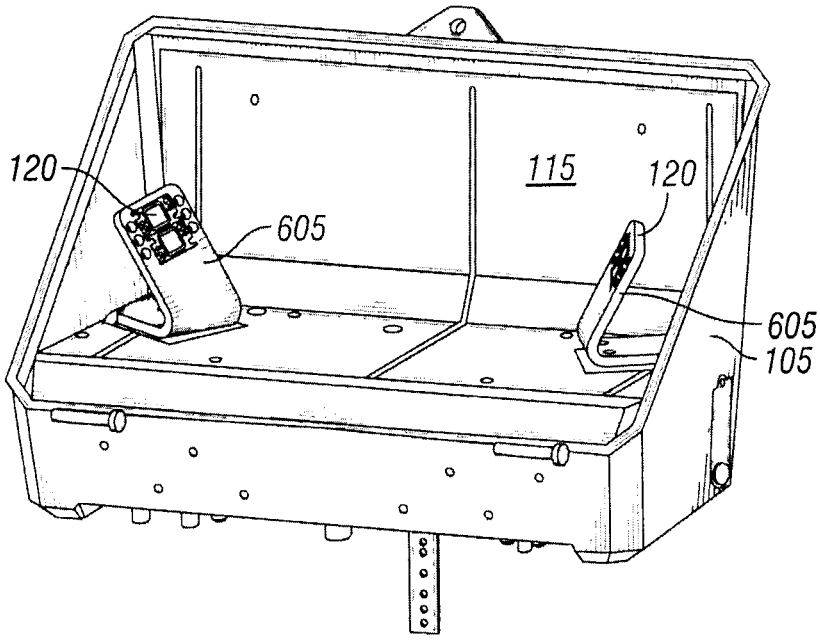
FIG. 6 illustrates a light fixture using multiple bracket-based LED light sources in accordance with a second embodiment of the invention.

FIG. 6 illustrates a light fixture using multiple bracket-based LED light sources in accordance with a second embodiment of the invention. As shown in the example embodiment of FIG. 6, the heat sink bracket 605 is mounted in a different location in the housing 105 (i.e., the back corner away from the housing aperture, as opposed to near the housing aperture as shown in the first embodiment of FIG. 1). Further, the shape of the heat sink bracket 605 is different than that of the brackets in FIG. 1. In one exemplary embodiment, the bottom portion of the bracket 605 is coupled to the reflector 115, the bottom of the housing 105, the side wall of the housing 105 or a plate coupled to the reflector 115, the bottom of the housing 105 or the side wall of the housing. This alternative shape and location allows for a different distribution of light from the fixture and provides a different thermal management footprint, which allows for alternative wattage and drive current solutions for powering the LEDs.

Figure 7A:
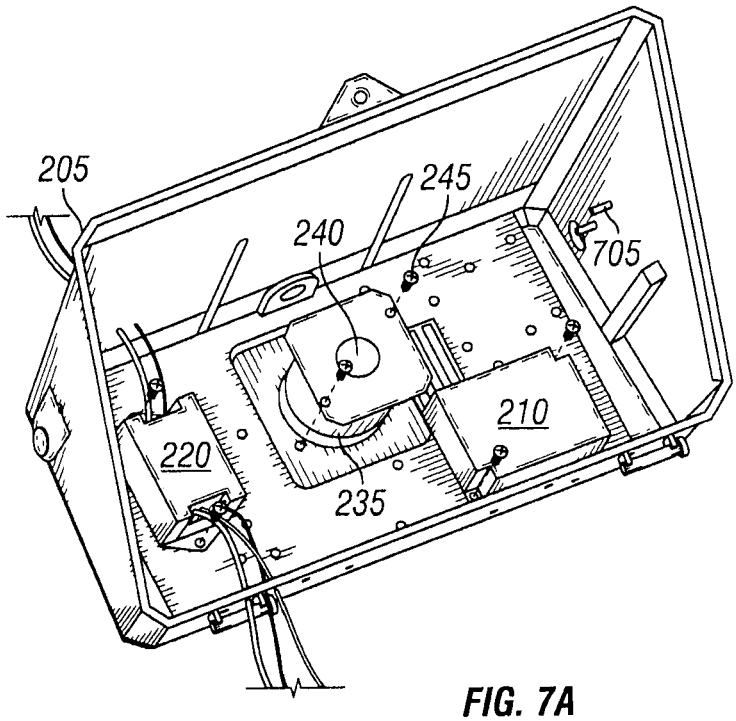
FIG. 7A illustrates a layout for the fixture without a battery backup in accordance with the embodiment of the invention shown in FIG. 6.

FIG. 7A illustrates a layout for the fixture without a battery backup in accordance with the embodiment of the invention shown in FIG. 6. Also shown in FIG. 7A is a mounting location 705 for mounting the heat sink brackets 605 in the back corner of the housing.

Figure 7B:
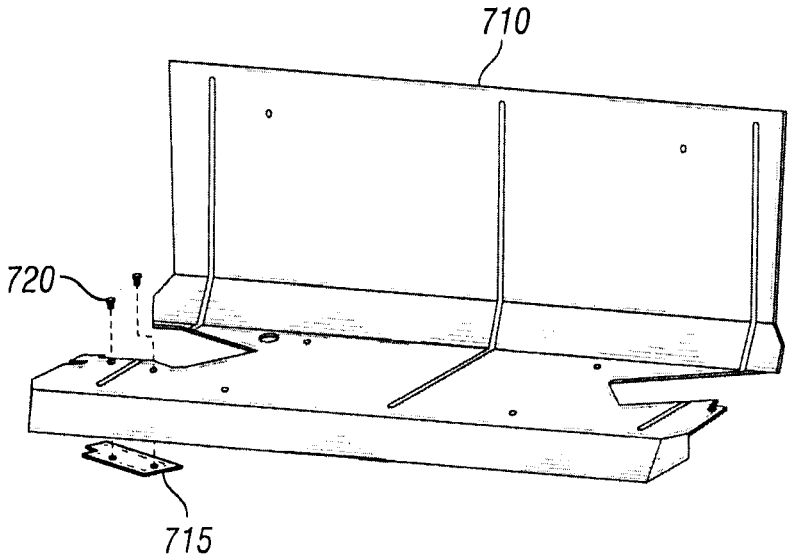
FIG. 7B illustrates a layout for the reflector incorporated into the fixture housing without a battery backup in accordance with the embodiment of the invention shown in FIG. 6.

FIG. 7B illustrates a layout for the reflector 710 incorporated into the fixture housing without a battery backup in accordance with the embodiment of the invention shown in FIG. 6. As shown in the example embodiment of FIG. 7B, the reflector 710 has a cover plate 715 for attaching the reflector to the fixture housing using, for example, a screw 720 or other attachment means (such as a rivet, nut and bolt, etc.).

Figure 8A:
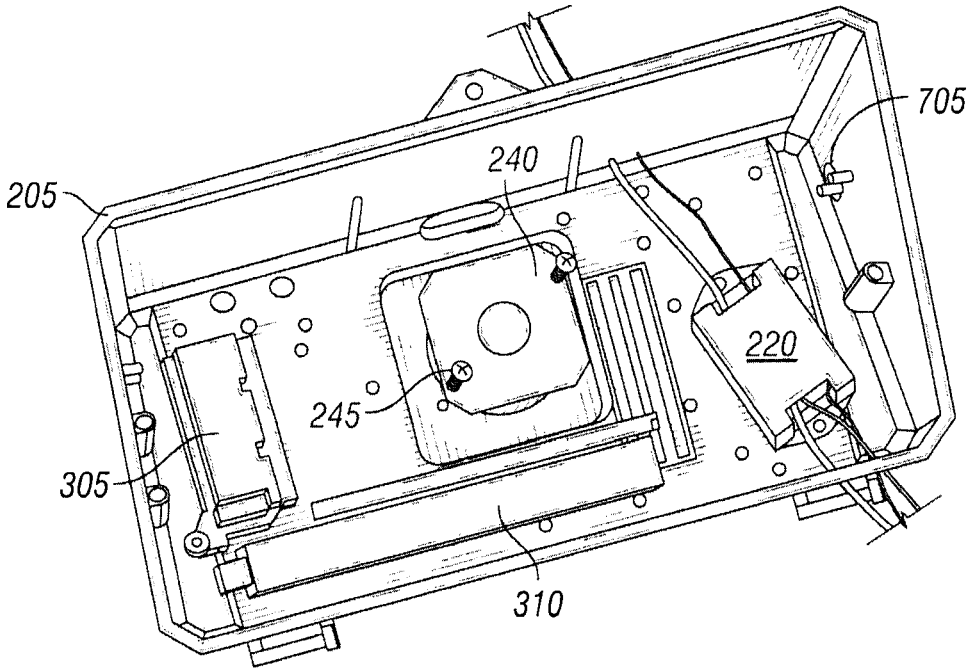
FIG. 8A illustrates a layout for the fixture with a battery backup in accordance with the embodiment of the invention shown in FIG. 6.
Figure 8B:
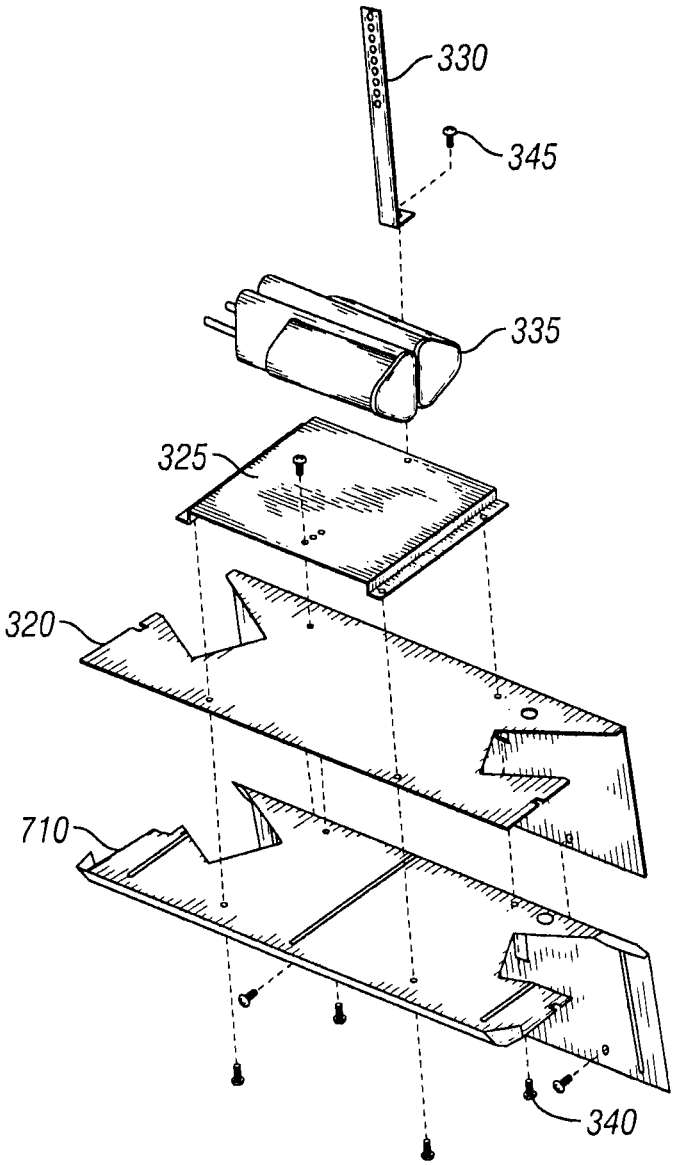
FIG. 8B illustrates a layout for the reflector incorporated into the fixture housing with a battery backup in accordance with the embodiment of the invention shown in FIG. 6.

FIG. 8A illustrates a layout for the fixture with a battery backup in accordance with the embodiment of the invention shown in FIG. 6. FIG. 8B illustrates a layout for the reflector 710 incorporated into the fixture housing with a battery backup in accordance with the embodiment of the invention shown in FIG. 6. As shown in FIG. 8B, a backup battery 335 may be incorporated into the fixture by being mounted to a battery mounting plate 325. In the embodiment shown in FIG. 8B the battery 335 is mounted to the battery mounting plate 325 through the use of a mounting strap 330 and screws 345. Other mounting or attachment means may be used in alternative embodiments. FIG. 8B further shows the battery mounting plate 325 attached to support plate 320 as well as the reflector 710 through the use of screws 340 or alternative mounting means not shown in FIG. 8B. In other embodiments of the invention, one or more of the battery mounting plate 325 or the support plate 320 may be omitted or made integral to each other rather than connected as separate pieces.

Figure 9:
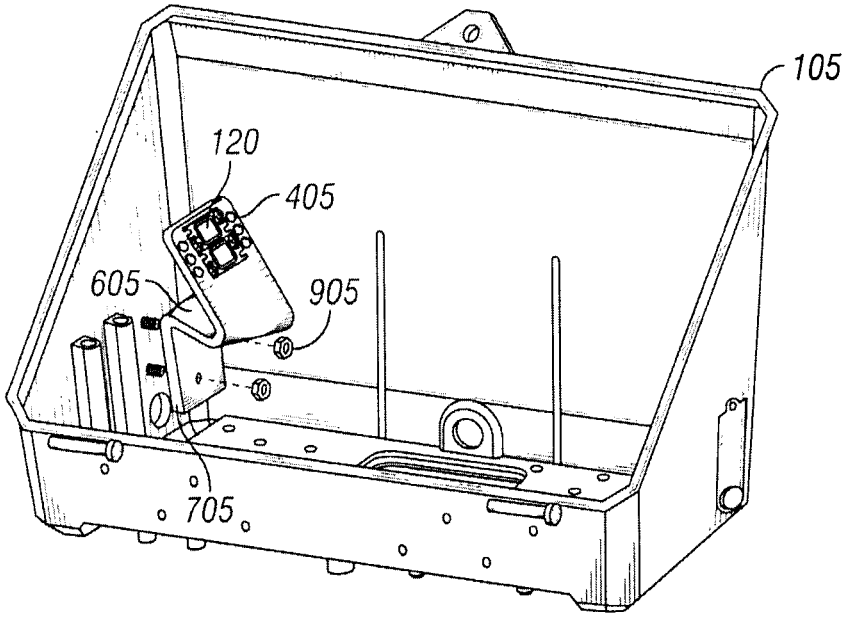
FIG. 9 illustrates a perspective view of the light fixture using at least one bracket-based LED light source in accordance with the embodiment of the invention shown in FIG. 6.

FIG. 9 illustrates a perspective view of the light fixture using at least one bracket-based LED light source in accordance with the embodiment of the invention shown in FIG. 6. As shown in FIG. 9, the heat sink bracket 605 has a bottom portion that is substantially vertical and is mounted to the housing using mounting means 905 (such as a screw and nut, rivet, etc.) at the mounting location 705. The bracket also includes a middle portion that extends along a horizontal or substantially horizontal plane as compared to the bottom portion. The bracket 605 also includes a top portion that extends generally upward from the middle portion. In one exemplary embodiment, the upper portion of the bracket 605 is angled along two different axes with respect to the middle portion of the bracket 605

Figure 10A:
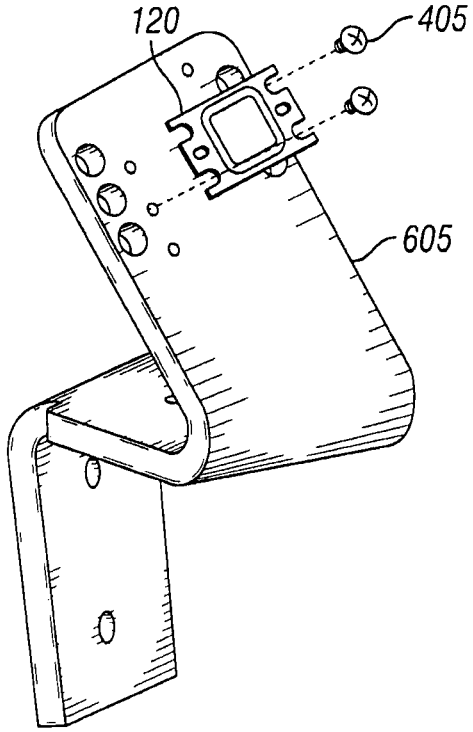
FIG. 10A illustrates a bracket-based LED light source with one LED light source for one side of the light fixture in accordance with one embodiment of the invention.
Figure 10B:
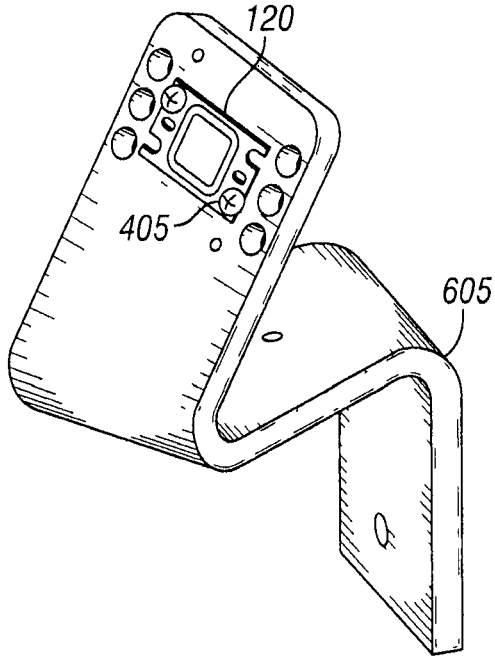
FIG. 10B illustrates a bracket-based LED light source with one LED light source complimentary to the bracket-based LED light source shown in FIG. 10A in accordance with one embodiment of the invention.
Figure 11A:
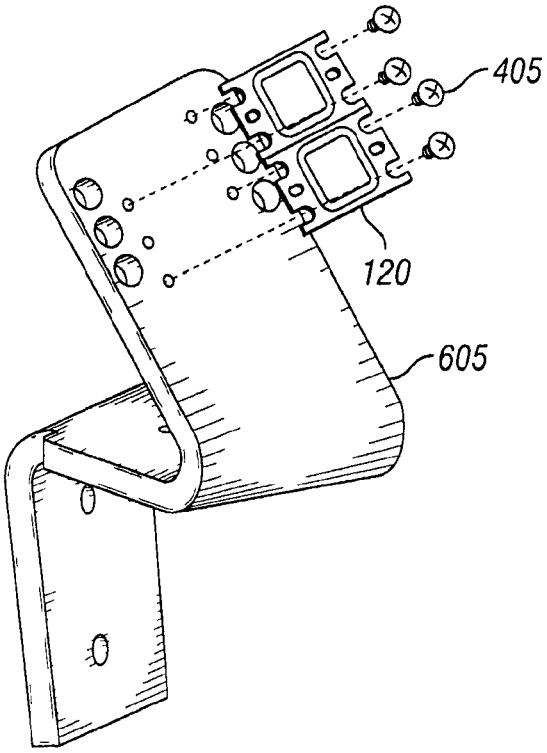
FIG. 11A illustrates a bracket-based LED light source with multiple LED light sources for one side of the light fixture in accordance with one embodiment of the invention.
Figure 11B:
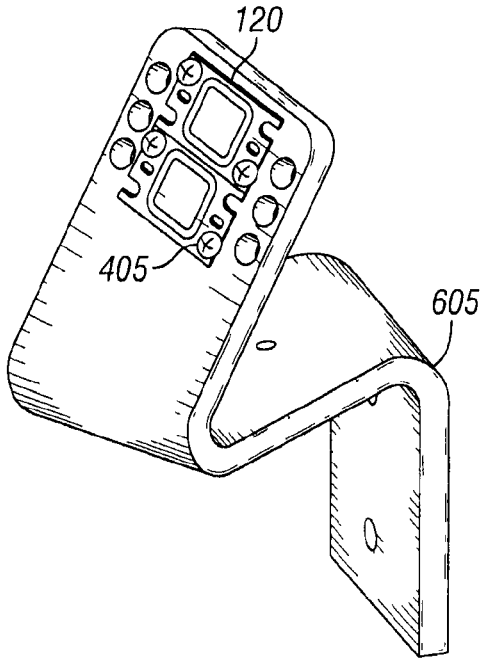
FIG. 11B illustrates a bracket-based LED light source with multiple LED light sources complimentary to the bracket-based LED light source shown in FIG. 11A in accordance with one embodiment of the invention.

FIG. 10A illustrates a bracket-based LED light source with one LED light source for one side of the light fixture in accordance with one embodiment of the invention. FIG. 10B illustrates a bracket-based LED light source with one LED light source complimentary to the bracket-based LED light source shown in FIG. 10A in accordance with one embodiment of the invention. Moreover, FIGS. 11A and 11B illustrate a bracket-based LED light source with multiple LED light sources for both sides of the light fixture similar to FIGS. 10A and 10B in accordance with one embodiment of the invention.

As shown in FIGS. 10A, 11A, 10B, and 11B, the LED light source 120 can be mounted to the heat sink bracket 605 through the use of mounting screws 405. Other mounting mechanisms may be used in other embodiments of the invention. Also shown in FIGS. 10A, 11A, 10B, and 11B are holes in the bracket 605, which may be used to route and/or secure wiring to the LED light source(s) 120 on the heat sink bracket (s) 605. In the example embodiments shown, the larger holes may be used for mounting the brackets 605 to the fixture housing or to another bracket or plate located in the fixture housing, or the larger holes may be used for routing wire leads to the LEDs. The heat sink brackets 605 are an example shape and orientation. As is shown in other figures and described herein the heat sink brackets 605 can be shaped and oriented in a variety of different ways depending on the thermal management and lighting performance needs for the fixture. The exemplary heat sink brackets 605 have a lower portion for mounting to the housing, a middle portion extending out from a sharp bend at one end of the lower portion, and an upper portion where the LED light source(s) are mounted. As shown in FIGS. 10A, 11A, 10B, and 11B, the middle portion and upper portion are separated by a sharp bend in the heat sink bracket, where the bend itself may be a straight bend or angled (i.e. bent along two axes) as shown. In some example embodiments of the invention the bracket may be further bendable and/or flexible to vary the location of the LEDs and/or the aim of the light emitted. In some embodiments of the invention, the heat sink brackets may be made up of separate pieces that are coupled together to form the desired shape or a one-piece bracket shaped accordingly as shown in FIGS. 10A, 11A, 10B, and 11B.

Figure 12:
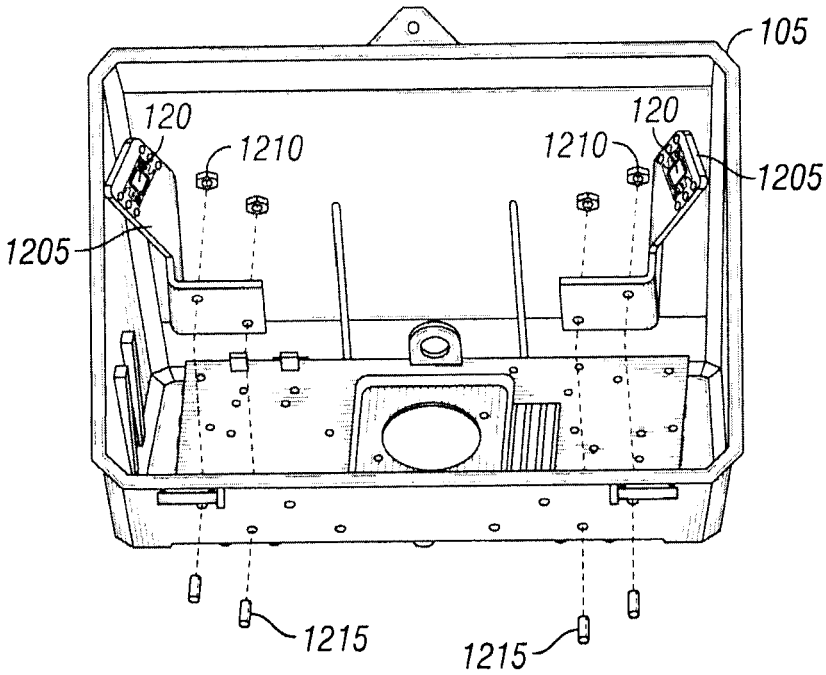
FIG. 12 illustrates a light fixture using multiple bracket-based LED light sources in accordance with a third embodiment of the invention.

FIG. 12 illustrates a light fixture using multiple bracket-based LED light sources in accordance with a third embodiment of the invention. As shown in the example embodiment of FIG. 12, the heat sink bracket 1205 is mounted in a different location in the housing (i.e., the front wall of the housing just below the housing aperture). Further, the shape of the heat sink bracket 1205 is different than that of the brackets in FIG. 1 or 6. This alternative shape and location allows for a different distribution of light from the fixture and provides a different thermal management footprint, which allows for alternative wattage and drive current solutions for powering the LEDs as desired. As shown in FIG. 12, the heat sink bracket 1205 is mounted to the housing using mounting or attachment means 1210 and 1215 (such as a screw and nut, rivet, etc.).

Figure 13:
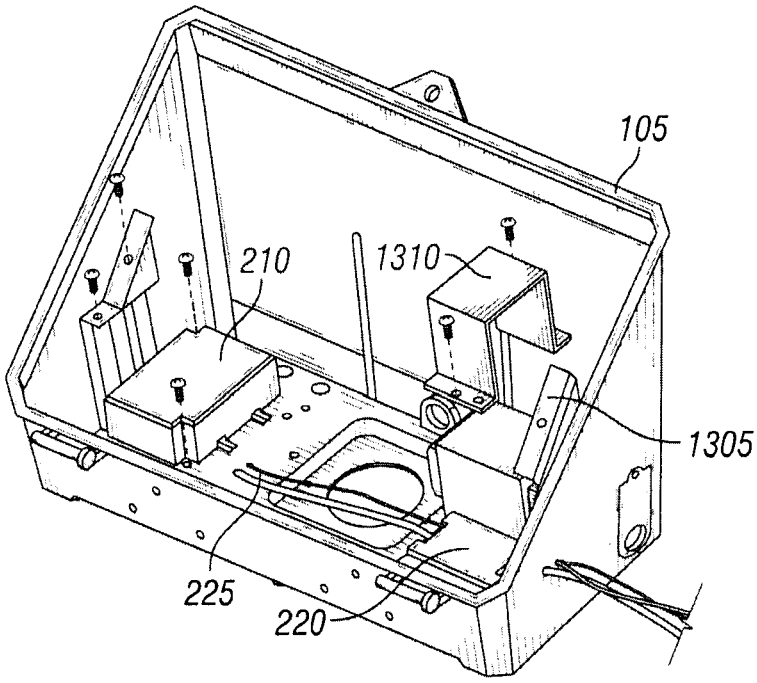
FIG. 13 illustrates a layout for the light fixture in accordance with the embodiment of the invention shown in FIG. 12.

FIG. 13 illustrates a layout for the light fixture in accordance with the embodiment of the invention shown in FIG. 12. Also shown in FIG. 13, the exemplary fixture includes a step down transformer 1405 (shown in FIG. 14) that is located and fixed to the housing by a transformer bracket 1310 and a plate 1305.

Figure 14:
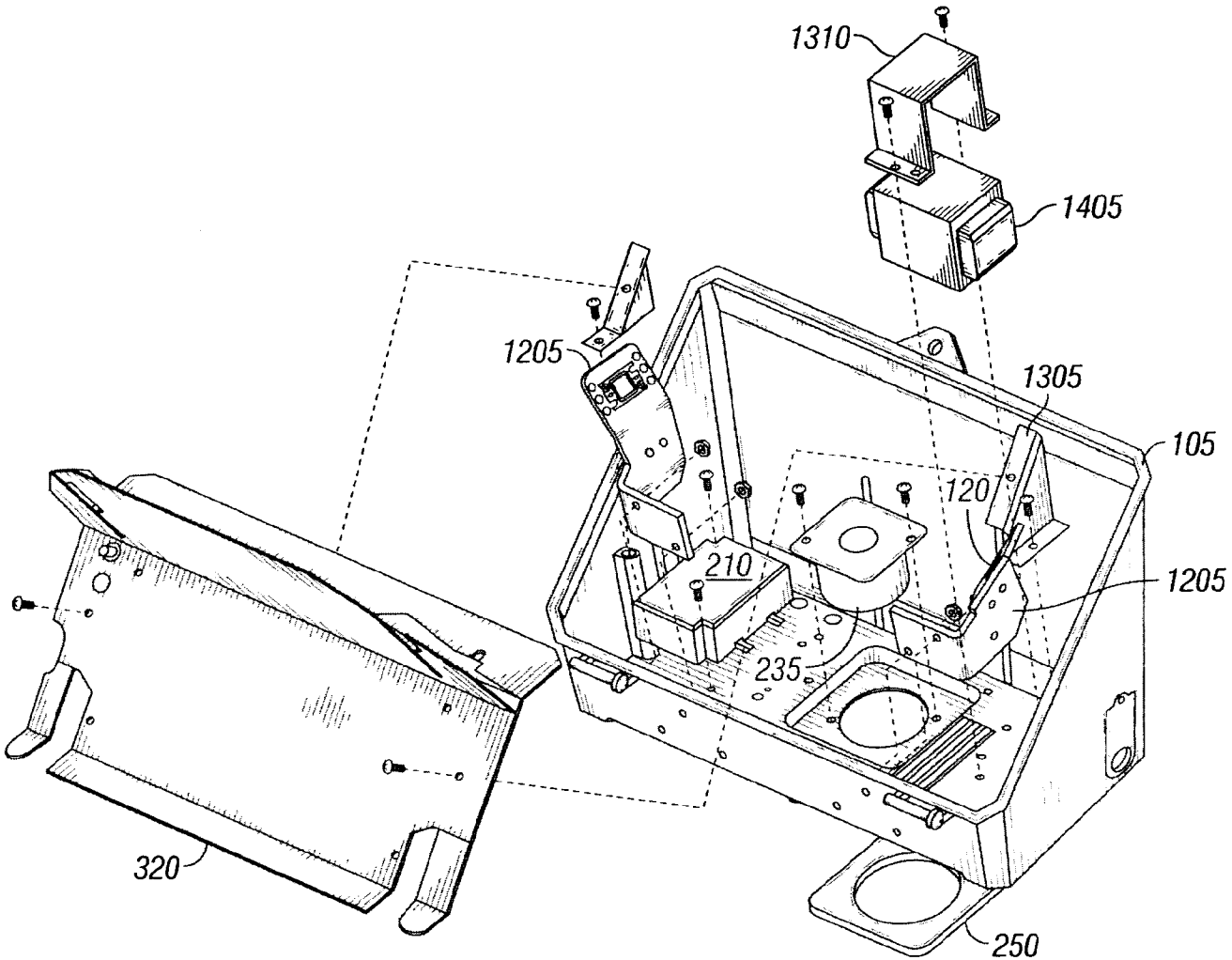
FIG. 14 illustrates an exploded view of the assembly for a light fixture with reflector in accordance with the embodiment of the invention shown in FIG. 12.

FIG. 14 illustrates an exploded view of the assembly for a light fixture with the transformer 1405, heat sink bracket 1205, wire way gasket 235, outlet box gasket 250, and reflector 320 in accordance with the embodiment of the invention shown in FIG. 12.

Figure 15B:
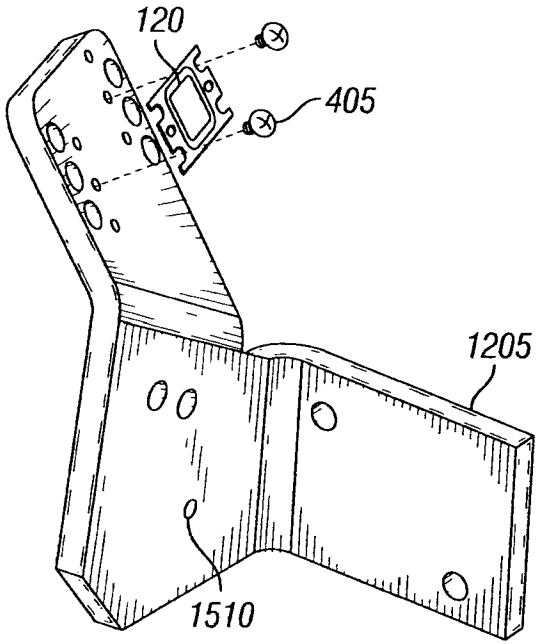
FIG. 15B illustrates a bracket-based LED light source with one LED light source complimentary to the bracket-based LED light source shown in FIG. 15A in accordance with one embodiment of the invention.
Figure 15A:
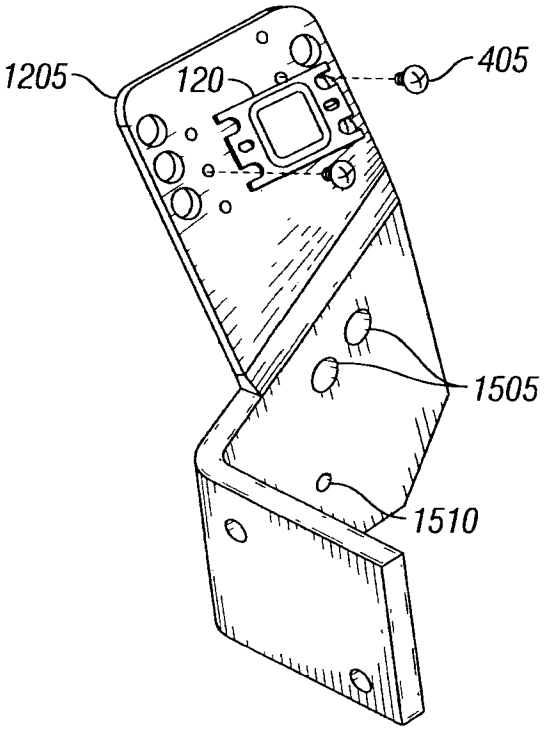
FIG. 15A illustrates a bracket-based LED light source with one LED light source for one side of the light fixture in accordance with one embodiment of the invention.
Figure 16B:
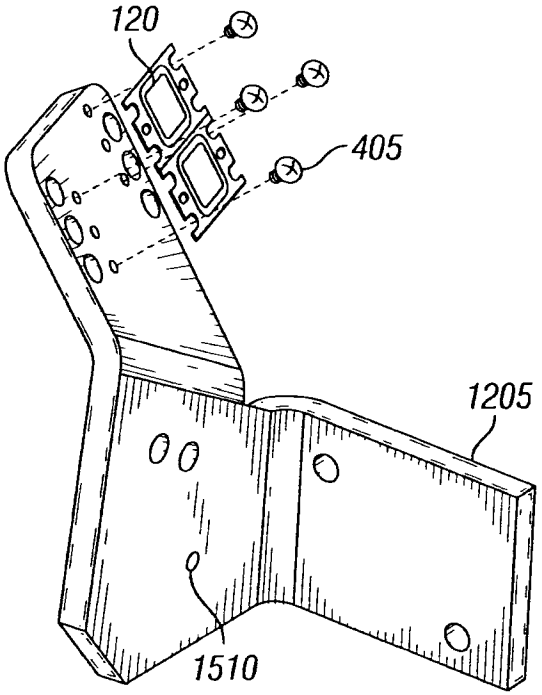
FIG. 16B illustrates a bracket-based LED light source with multiple LED light sources complimentary to the bracket-based LED light source shown in FIG. 16A in accordance with one embodiment of the invention.
Figure 16A:
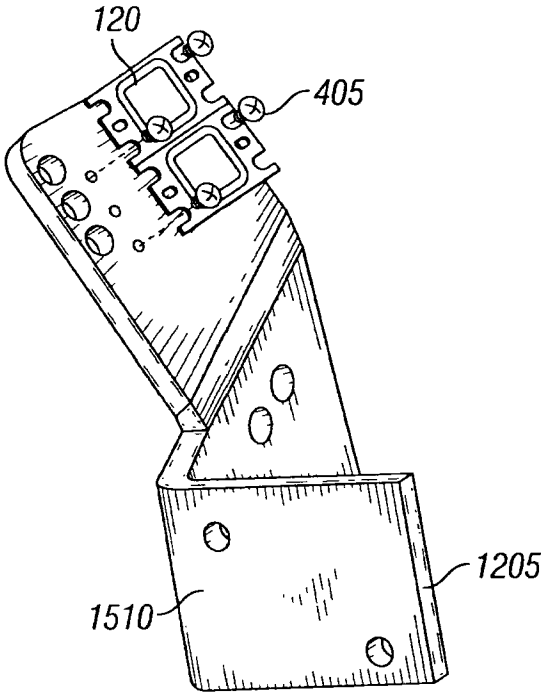
FIG. 16A illustrates a bracket-based LED light source with multiple LED light sources for one side of the light fixture in accordance with one embodiment of the invention.

FIG. 15A illustrates a bracket-based LED light source with one LED light source for one side of the light fixture in accordance with one embodiment of the invention. FIG. 15B illustrates a bracket-based LED light source with one LED light source complimentary to the bracket-based LED light source shown in FIG. 15A in accordance with one embodiment of the invention. Moreover, FIGS. 16A and 16B illustrate a bracket-based LED light source with multiple LED light sources for both sides of the light fixture similar to FIGS. 15A and 15B in accordance with one embodiment of the invention.

As shown in FIGS. 15A, 16A, 15B, and 16B, the LED light source 120 can be mounted to the heat sink bracket 1205 through the use of mounting screws 405. Other mounting or attachment mechanisms may be used in other embodiments of the invention, including, but not limited to thermal grease, heat tape, and liquid or semi-liquid adhesives. Also shown in FIGS. 15A, 16A, 15B, and 16B are holes in the bracket 1205, which may be used to route and/or secure wiring for supplying a source of power to the LED light source(s) 120 on the heat sink bracket(s) 1205. In the example embodiments shown, the larger holes may be used for mounting the brackets 1205 to the fixture housing (or to another bracket or plate located in the fixture housing), or the larger holes may be used for routing wire leads to the LEDs. The heat sink brackets 1205 are an example shape and orientation. As is shown in other figures and described herein the heat sink brackets 1205 can be shaped and oriented in a variety of different ways depending on the thermal management and lighting performance needs for the fixture. The heat sink brackets 1205 have a lower portion for mounting to the front wall of the housing, a middle portion extending out from a sharp bend (the bend itself may be a straight bend or angled as shown) at one side of the lower portion, and an upper portion where the LED light source(s) are mounted. As shown in FIGS. 15A, 16A, 15B, and 16B, the middle portion and upper portion are separated by a slight bend to the side in the heat sink bracket 1205 above the middle portion, where the bend itself may be a straight bend or angled as shown. In some example embodiments of the invention the bracket may be further bendable and/or flexible to vary the location of the LEDs and/or the aim of the light emitted. In some embodiments of the invention the heat sink brackets may be made up of separate pieces or a one-piece bracket shaped accordingly as shown in FIGS. 15A, 16A, 15B, and 16B.

Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

The invention claimed is:

1. A light fixture comprising:

a housing with a bottom wall, a front wall, a back wall, and at least two side walls, wherein the housing forms an aperture;

a reflector coupled to the housing and disposed at least partially within the aperture; and a plurality of bracket-based light emitting diode (LED) light sources segments, each bracket-based LED light sources segment comprising:

a heat sink bracket coupled within the housing to at least one of the front wall, the back wall, or the at least two side walls of the housing and having at least one bend, wherein the heat sink bracket includes a lower portion and an upper portion and wherein the lower portion includes at least one aperture for mounting the heat sink bracket to the housing; and at least one LED coupled to the upper portion of the heat sink bracket.

2. The light fixture of claim 1, wherein the housing is a wall mount housing.

3. The light fixture of claim 1, wherein the heat sink bracket is shaped to position the LED light source to emit a particular optical distribution from the aperture of the housing.

4. The light fixture of claim 1, wherein the heat sink bracket is shaped to thermally disburse heat radiating from the LED light source.

5. The light fixture of claim 1, wherein a portion of the heat sink bracket is flexible.

6. The light fixture of claim 1, wherein the LED light source comprises and LED chip on board.

7. A light fixture comprising:

a housing with a bottom wall, a front wall, a back wall, and at least two side walls, wherein the housing forms an aperture;

at least one heat sink bracket mounted to at least one of the front wall, the back wall, or the at least two side walls of the housing, wherein the heat sink bracket includes:

a lower portion, wherein the lower portion contains at least one aperture for mounting the at least one heat sink bracket to the housing, a middle portion, and an upper portion; and at least one light emitting diode (LED) mounted to the upper portion of the at least one heat sink bracket.

8. The light fixture of claim 7, wherein the middle portion includes at least one routing aperture for threading wiring providing power to the at least one LED.

9. The light fixture of claim 8, wherein the upper portion includes at least one lead aperture for threading at least one wire lead providing power to the at least one LED.

10. The light fixture of claim 9, wherein the at least one lead aperture is larger in size than the at least one routing aperture.

11. The light fixture of claim 10, further comprising a wire way gasket.

12. The light fixture of claim 11, further comprising an outlet box gasket.

13. The light fixture of claim 7, wherein the middle portion and upper portion are integral to each other and separated by a bend in the at least one heat sink bracket.

14. The light fixture of claim 13, wherein the upper portion is bendable in relation to the middle portion.

15. The light fixture of claim 7, wherein the at least one heat sink bracket is mounted to at least two of the front wall, the back wall, or the at least two side walls of the housing.

16. The light fixture of claim 7, wherein the lower portion is in sufficient contact with the housing to thermally route heat generated by the at least one LED to the housing.

17. The light fixture of claim 7, wherein the lower portion is in sufficient contact with a plate within the housing to thermally route heat generated by the at least one LED to the plate.

18. A light fixture comprising:

a housing with a plurality of side walls forming an aperture;

at least one heat sink bracket located within the housing, wherein the at least one heat sink bracket includes:

a lower portion, wherein the lower portion contains at least one mounting aperture for mounting the at least one heat sink bracket, a middle portion, and an upper portion, wherein the upper portion or middle portion includes at least one routing aperture for threading at least one wire, and wherein the middle portion and upper portion are integral to each other and separated by a bend in the at least one heat sink bracket; and at least one light emitting diode (LED) mounted to the upper portion of the at least one heat sink bracket.

19. The light fixture of claim 18, wherein a portion of the bracket is flexible.

20. The light fixture of claim 18, wherein the LED comprises and LED chip on board.

* * * * *